US005100036A

United States Patent [19]

Rogers et al.

[11] Patent Number: 5,100,036

[45] Date of Patent: Mar. 31, 1992

[54] HANDGUN HOLSTER WITH TRIGGER GUARD RESTRAINT

[75] Inventors: William H. Rogers; Norman E. Clifton, Jr., Jacksonville, both of Fla.

[73] Assignee: Safariland, Ltd., Inc., Ontario, Calif.

[21] Appl. No.: 665,097

[22] Filed: Mar. 6, 1991

[51] Int. Cl.[5] ..... F41C 33/02

[52] U.S. Cl. ..... 224/244; 224/911; 224/193

[58] Field of Search ..... 224/244, 243, 911, 193

[56] References Cited

U.S. PATENT DOCUMENTS

| | | | |
|---|---|---|---|
| 4,101,060 | 7/1978 | Bianchi et al. | 224/911 |
| 4,694,980 | 9/1987 | Rogers | 224/911 |
| 4,905,880 | 3/1990 | Cupp | 224/243 |
| 4,925,075 | 5/1990 | Rogers | 224/193 |
| 5,048,735 | 9/1991 | McCormick | 224/244 |
| 5,054,670 | 10/1991 | Gallagher | 224/911 |

*Primary Examiner*—Linda J. Sholl
*Attorney, Agent, or Firm*—Arthur G. Yeager

[57] ABSTRACT

A restraining device in a holster has a rigid body portion and two upwardly extending oppositely facing wall members with a cavity in each and forming a channel receiving a handgun trigger guard, a pair of cam-shaped restraining members having two lobes and a pivot pin therebetween for movement on generally parallel axes within respective cavities. One lobe is spring biased to extend inwardly of channel when empty and pushed outwardly of channel when such guard is seated in channel; and the other lobe is retracted into its cavity when empty so trigger guard may pass between opposed lobes and extend inwardly of such guard when seated in channel. Forward handgun dislodgment is prevented and a vertical draw is needed when such pins are generally horizontal to overcome frictional handgun-holster contact to remove handgun above partially closed lower front. Restraining members, being caged within cavities, provide enhanced strength from handgun removal in the forward direction. When pivot pins are generally vertical, handgun must be slightly rotated forward so guard bottom passes pins and then withdrawn.

28 Claims, 4 Drawing Sheets

HANDGUN HOLSTER WITH TRIGGER GUARD RESTRAINT

BACKGROUND OF THE INVENTION

This invention relates to a handgun holster with an adjustable restraint device for retaining the handgun in the holster and preventing it from removal not intended by the wearer.

Law enforcement officers, and particularly competitive shooters who have a need to carry a handgun normally do so in a holster, and it is important that the holster permit a "quick draw", and yet be secure in the holster against falling out when the wearer is running or otherwise involved in activity, and against the possibility of withdrawal by someone other than the wearer. Various arrangements have been used such as, cover flaps, restraining straps, spring mechanisms, custom molding of the holster to fit each gun, and the like. Typical of such arrangements are those shown in my U.S. Pat. No. 4,694,980; in U.S. Pat. No. 4,101,060 to Bianchi; and my U.S. Pat. No. 4,925,075. The present invention discloses improvements over all of these prior art holsters.

It is an object of the present invention to provide an improved handgun holster. It is another object of this invention to provide an improved holster having a novel means for restraining the handgun from being withdrawn from the holster until the wearer intends to do so. Still other objects will become apparent from the more detailed description which follows.

BRIEF SUMMARY OF THE INVENTION

This invention relates to an improved handgun holster which is designed to permit withdrawal from the holster only when the initial movement of the handgun is vertically upward, the holster having a restraining device attached to the inside of the back of the holster adjacent its top, the restraining device being an elongated article having a solid rigid body portion and two upwardly extending vertical side wall members attached to opposite sides, respectively, of the body portion, said side walls forming a channel for receiving and seating a trigger guard. The side wall members each having a cavity therein for receiving a spring biased cam-shaped restraining member having a pair of lobes pivotally mounted therebetween about an axis, one lobe being biased to extend inwardly into such channel when the holster is empty and to be moved outwardly into the cavity of its side wall when the trigger guard is seated in the channel, and the other lobe being biased to be retracted into the cavity of its side wall when the holster is empty and to extend inwardly of the trigger guard to lock same when the trigger guard is seated in the channel. When the locking lobes are positioned to prevent forward movement of the handgun, the other lobes are caged within the cavities of the side wall which provide enhanced strength against any forward movement of the handgun.

In specific and preferred embodiments of the invention there is included an adjusting screw to tighten the two side walls and thereby make a tighter fit for the handgun. For various handguns, the same side wall members may be employed with only differing body portions to accommodate for various handguns. The axis on which the restraining members are mounted may be horizontal which would require a vertical draw to unlock or vertical which would require a forward tilt of the handgun to unlock before further withdrawal to a shooting position.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The various features of this invention are best understood from the following description with reference to the accompanying drawings.

Figure 1:
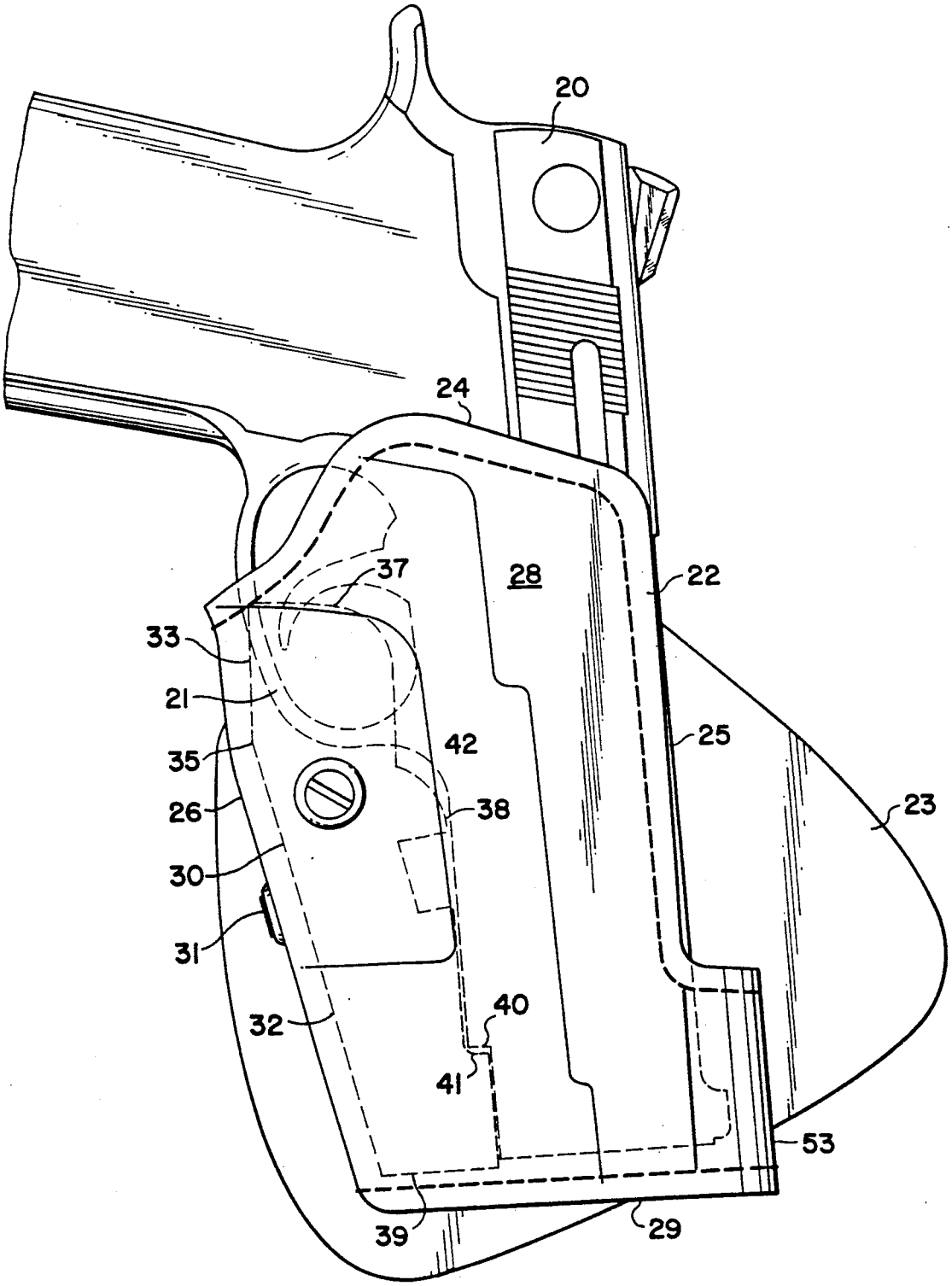
FIG. 1 is an outside elevational view of the first embodiment of the holster of this invention with an automatic handgun therein.
Figure 2:
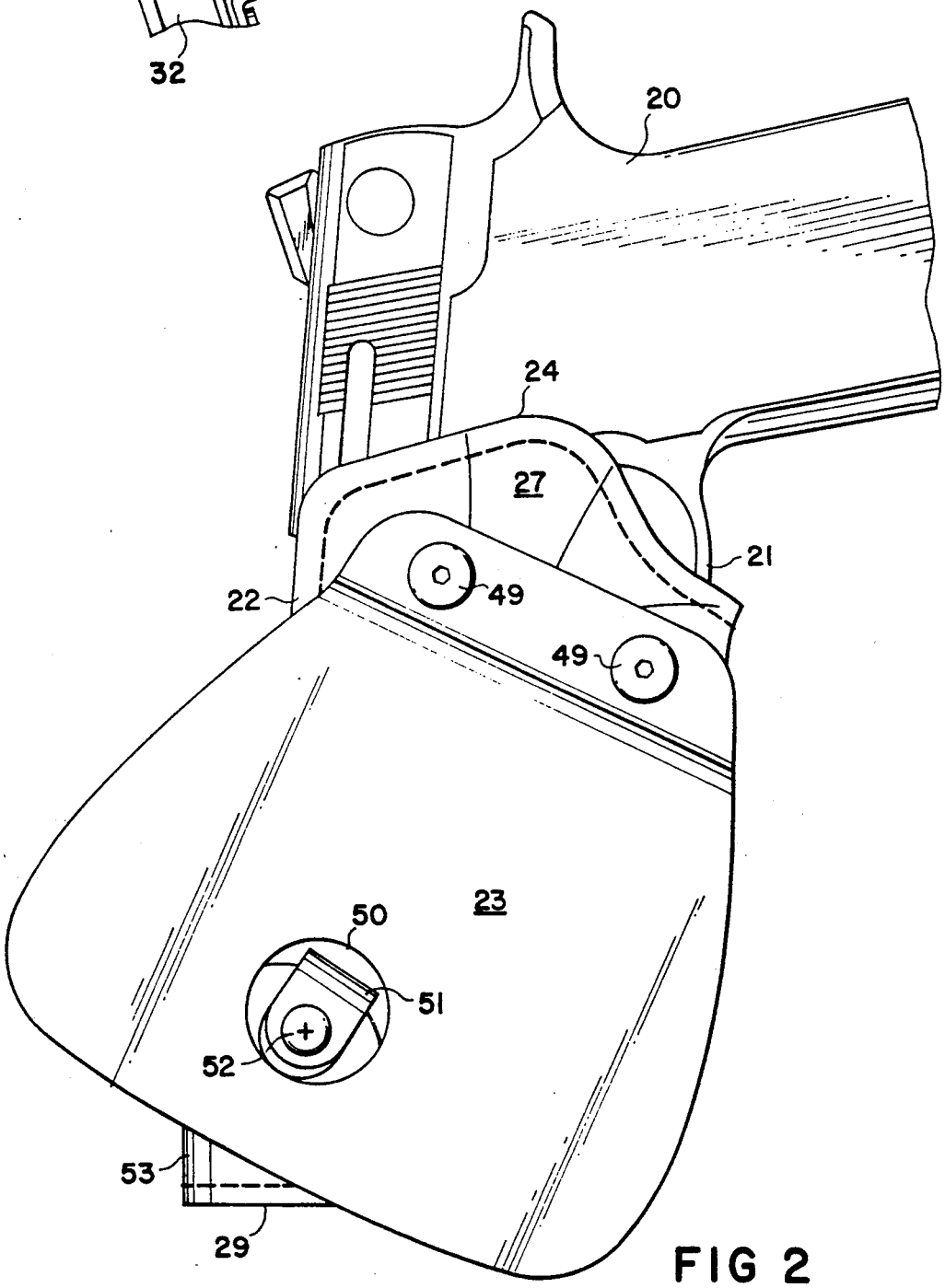
FIG. 2 is an inside elevational view of the holster and handgun of FIG. 1.
Figure 3:
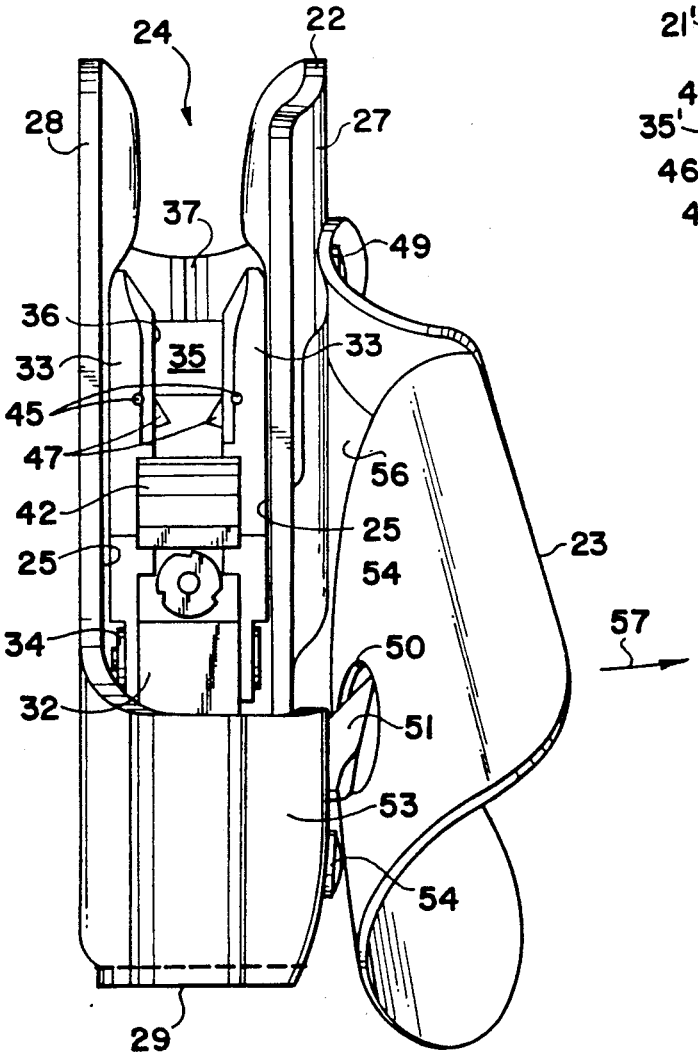
FIG. 3 is a front elevational view of the holster of this invention.

The holster, as seen in FIGS. 1–3, comprises an inner wall 27 and an outer wall 28, an open top 24, a bottom 29, enclosing a space in which a handgun is carried. These components as well as others in the following disclosure, are intended to describe directions and relative locations with respect to the wearer of the holster. Thus, inner wall 27 is closer to the body of the wearer than outer wall 28, and top 24 is vertically above bottom 29. A space 56 for the waist belt of the wearer is formed between hip pad 23 and inner wall 27. Hip pad 23 is attached to holster 22 by screws 49 leaving the lower end free to be sprung outward in the direction of arrow 57. When hip pad 23 is sprung outward, the waist belt of the wearer can be slid over stop tab 51 which is wedge-shaped to its normal position. Hole 50 in hip pad 23 is provided to permit tab 51 to extend outward when the holster is in place to provide a positive stop to prevent unintended release of the holster 22 from the belt. Screw 52 holds tab 51 fixed against inner wall 27. The inside of the hip pad resting against the wearer is preferably molded into a concave shape to fit the wearer's contours.

Holster 22 has an open front 25 extending from open top 24 to flap 53 which wraps around from front 25 to inner wall 27 and is fastened thereto with screw 54. Bottom 29 is open but handgun 20 cannot extend through bottom 29, because the restraining device 30, hereinafter more fully described, holds the handgun 20 in place due to its being molded to engage and fit the trigger guard of handgun 20.

The principal improvement of this invention which is believed to be novel and inventive is the restraining device 30 which is fastened within the holster 22 along its back 26 generally medially between top 20 and bottom 29. A preferred method of fastening the device 30 to the holster back 26 is by screw 31 passing through holster back 26, hole 55 in device 30 and engaged with threaded nut 54. Other fastening methods, e.g., riveting or cementing, are entirely suitable for some purposes. Restraining device 30 is an elongated article having a solid, rigid main body member 32 to which are attached two upwardly extending side wall members 33 by rivet 34 or other equivalent fastening means. The attachment to side wall members 33 is only at the bottom ends 58, leaving upper ends 59 free to flex in the direction of arrow 60. The rigid main body member 32 may thus be molded to the desired length and shape, particularly the trigger guard corresponding to the handgun to be holstered and the same side wall members 33, as shown herein, may be connected thereto to form a restraining device 30 which corresponds to that particular handgun.

Main body member 32 is a rigid solid which is formed to fit inside holster 22 against its back wall 26 and to form a base to which side wall wings or members 33 are attached. Side wall wings 33 together with back 35 of body member 32 form a channel or recess 36 into which the trigger guard 21 of handgun 20 is seated. Channel or recess 36 is open at the top and at the front. The flexibility of side wall wings 33 assists in permitting proper entry and seating of handgun 20 into holster 22, particularly trigger guard 21 into restraining device 30. The amount of flexibility of side wall wings 33 is adjustable by means of a screw 48 passing through hole 43 to a nut (not shown) attached to inner wall 27. Tightening screw 48 pulls side wall wings 33 closer together, thus applying a tighter grip on handgun 20, making it more difficult to push handgun 20 into holster 22, and vice versa making it more difficult to draw handgun 20 from holster 22. The latter difficulty is actually a benefit in securing handgun 20 in holster against falling out during a scuffle and providing some protection against withdrawal of the gun by someone other than the wearer.

Figure 9:
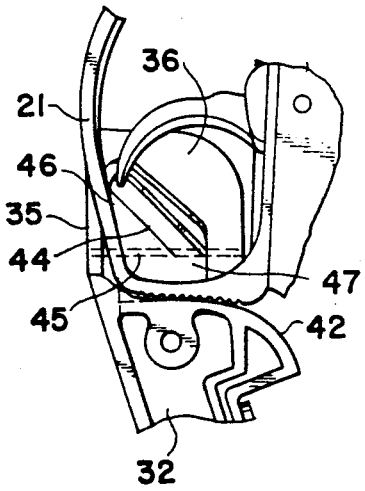
FIG. 9 is a side elevational view of a portion of the restraining device of this invention showing details of engagement with trigger guard of a handgun.
Figure 4:
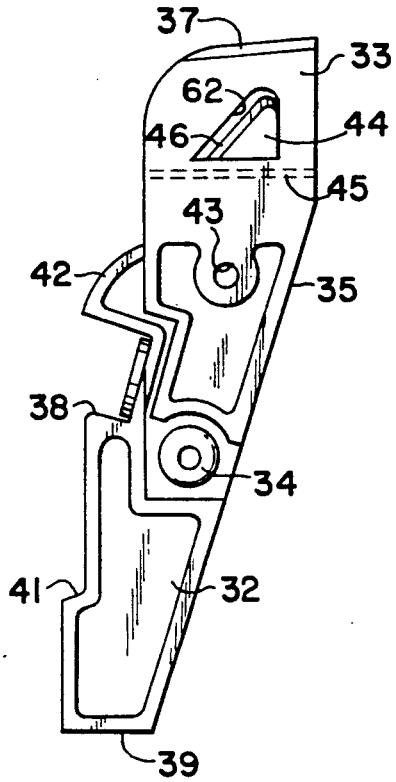
FIG. 4 is a side elevational view of the gun restraining device of this invention.
Figure 8:
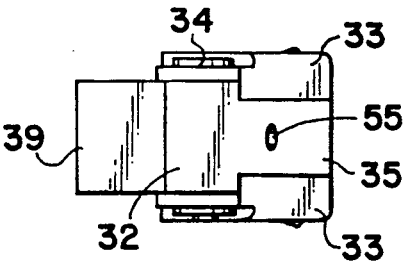
FIG. 8 is a bottom plan view of the gun restraining device of this invention.

The restraining element 44 in member 30 is a cam-shaped article in each side wall wing 33, each element 44 having a generally triangular and vertically extending upper lobe 46 and a generally rectangular and horizontally extending lower lobe 47 and a pivot pin 45 passes therethrough generally between the lobes 46 and 47. Element 44 pivots about pin 45 so as to expose the end of lobe 46 or the end of lobe 47 in channel 36. The dimensions of element 44 and the positioning of pivot pin 45 are such that lobe 47 contacts the side edges of the trigger guard 21 of handgun 20 when handgun 20 is holstered. The side edges of the trigger guard 21 force horizontal lobes 47 outward away from trigger guard 21 and substantially flush into recess 62 in side wall wing 33 causing element 44 to pivot about pin 45 and causing the end of each vertical lobe 46 to extend inwardly into channel 36 and inside of trigger guard 21, providing a positive restraint against handgun 20 falling out of or being removed from holster 22, particularly forwardly. This positive restraint position is shown in FIGS. 8 and 9. When it is desired to draw handgun 20 from holster 22, the handgun 20 is pulled vertically upward. In the first portion of this movement, through a distance of about one-half of the thickness of the trigger guard (best seen in FIG. 10), the contact between horizontal lobe 47 and trigger guard 21 is being removed or released and the vertical lobes 46 are being pushed outwardly into side wall wings 33 by the trigger guard 21 allowing handgun 20 to be drawn from holster 22. Each element 44 is biased by a spring 61 in recess or cavity 63 pushing outwardly on horizontal lobe 47 to extend the end of lobe 47 into channel 36. When the end of horizontal lobe 47 projects into channel 36, the end of vertical lobe 46 is retracted within recess 62, the upper portion thereof being open and the lower portion being closed as shown most clearly in FIG. 4, to leave channel 36 open thereat and unobstructed for entry of trigger guard 21 thereinto when handgun 20 is pushed into holster 22. Spring 61 may be any type or design of spring, such as coil, leaf, bent wire, or the like. When lobes 46 are in the locking position shown in FIGS. 9 and 10, lobes 47 are retracted substantially flush with the inner walls of wings 33 forming the channel 36: and this condition exists as long as the trigger guard 21 is locked therein. Since restraining members 44 are sized to be in close contact with the vertical walls forming the recess or cavity 62 in each of the wings 33, enhanced strength is provided by such contact which counteracts any force applied to the handgun handle which would tend to unholster the handgun by a forward force without prior upward withdrawal. In other words, the pivot pins 45 are protected and do not need to be overly strong to resist such force since it is distributed from members 44 to the recess or cavity 62 of each wing 33 and thence to solid body member 32. The locking of the trigger guard 21 is seen to be on the bottom portion inside surface thereof which is engaged by the lobes 46 of restraining emmbers 44.

At the top end of main body 32 is a rounded convex tongue 42 which extends forwardly from the bottom of channel 36. This tongue 42 serves as a guide to lead the muzzle of the handgun and thus the trigger guard 21 into channel 36 simply by feel, thus facilitating in the holstering of handgun 20.

At the lower portion of main body 32 adjacently above bottom 39 there is a horizontal ledge 41 positioned to receive a mating horizontal ledge 40 on a handgun 20. This is not a critical component of this invention, but is a convenient option to employ to provide a more secure and positive seating for handgun 20 in holster 22. Ledge 41 is positioned to match the contours of handgun 20, and therefore may be different in design and/or location depending on the type and model of handgun 20.

Figure 11:
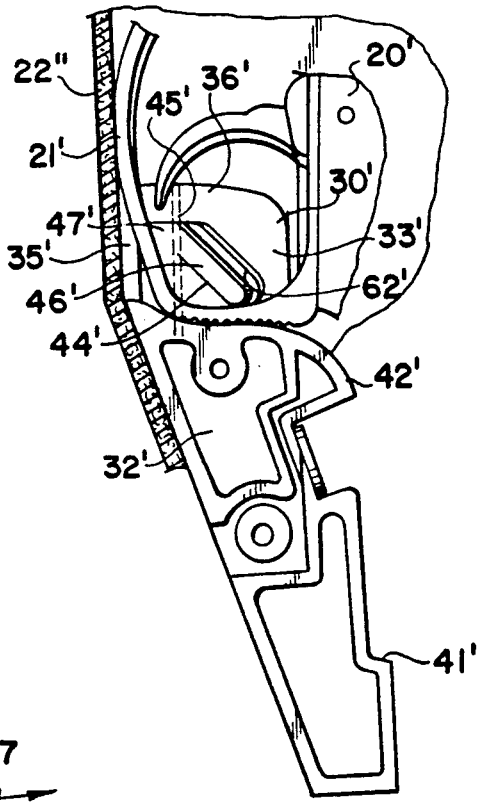
FIG. 11 is another embodiment of a portion of the holster with a modified gun restraining device of this invention.

Another embodiment of the holster 22′ is depicted in FIG. 11 in which corresponding parts are similarly designated. In this construction of the restraining device 30′, each side wall wind 33′ has a recess or cavity 62′ in which restraining element 44′ is movably mounted by a generally vertical pivot pin 45′. To properly position the handgun 20′ in holster 22′, the handgun 20′ is inserted into the holster 22′ with the trigger guard 21′ positioned at least forwardly of pivot pins 45′ with a portion in proper position on or closely adjacent ledge 41′ and then the handgun 20′ is rotated rearwardly toward back 35′. Thus the bottom of the trigger guard 21′ engages the lobes 47′ to pivot about vertical axes 45′ into the recesses 62 and force lobes 46' into the channel 36' and prevent the handgun 20 from being drawn upwardly. As seen the lock of lobes 46' is on the front portion of the trigger guard 21', i.e., on the inside surface of such front portion. Reference is made to our copending application Ser. No. 07/364,323, filed Jun. 12, 1989, entitled Handgun Holster With Trigger Guard Restraint, in which a holster is disclosed with a security strap. Some type of security strap would normally be included in a holster 22' employing restraining device 30' so that forward movement is prevented without first releasing the security strap as would be well known in the art.

Figure 7:
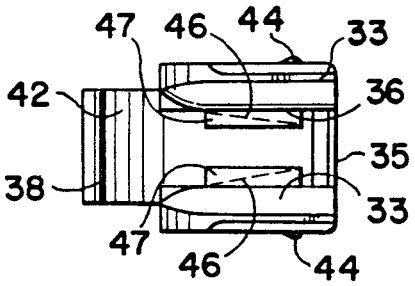
FIG. 7 is a top plan view of the gun restraining device of this invention.
Figure 5:
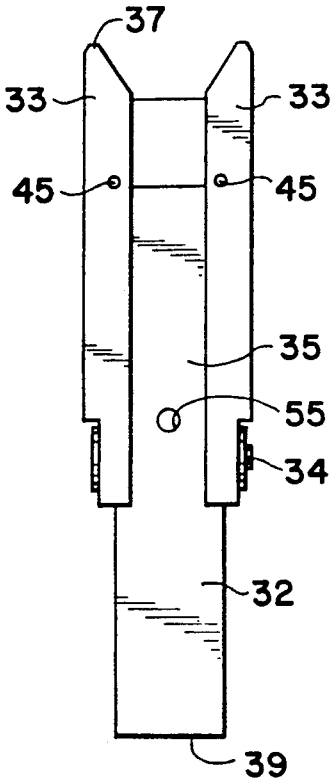
FIG. 5 is a back elevational view of the gun restraining device of this invention.
Figure 6:
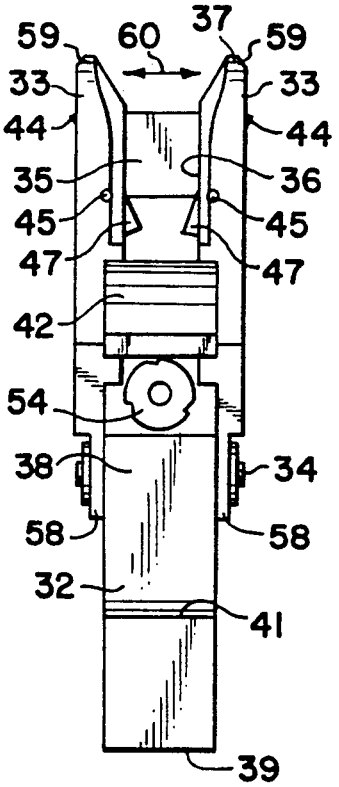
FIG. 6 is a front elevational view of the gun restraining device of this invention.
Figure 10:
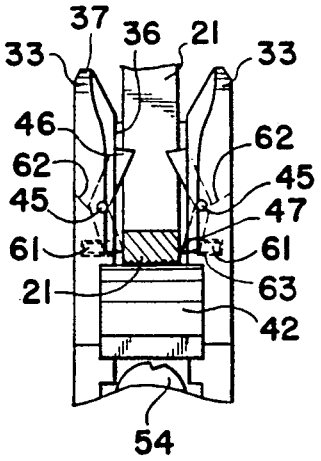
FIG. 10 is a front elevational view of the portion shown in FIG. 9.

Thus, in the embodiment depicted in FIGS. 1–10, no forward dislodgment is permitted without first withdrawal of the handgun 20 vertically approximately so the trigger guard 21 moves to a position so that restraining members 44 begin pivoting from their locking positions shown in FIG. 10 to their fully unlocking position shown in FIGS. 6 and 7. The handgun 20, after the muzzle clears the front flap 53 may then be rotated to a shooting position. In the embodiment of FIG. 11 no upward dislodgment is permitted without first releasing a security strap (not shown) rotating or pivoting or moving the handle of the handgun 20 forwardly about shoulder 41 so that the trigger guard 21 moves to a position so that restraining members 44' begin pivoting from their locked positions shown in FIG. 11 to an unlocked position (not shown) with lobes 47' moving inwardly of channel 36' and lobes 46' moving outwardly of channel 36', i.e., pivoting about pins 45', to unblock trigger guard 21' and thence the handgun can be withdrawn in a normal manner. To re-holster the handgun into the holster of FIGS. 1–10, the handgun is merely repositioned substantially vertically downwardly. To reholster into the holster of FIG. 11, the handgun is repositioned with the handle slightly forwardly of its fully holstered position with the muzzle on or juxtaposed to ledge 41' and then the handle is moved rearwardly causing lobes 47' to be moved outwardly of the channel 36' and lobes 46' to extend into the channel 36' to lock up the trigger guard adjacent its forward portion. The safety strap is then engaged with the handgun and secured.

Holster 22 preferably is made of a moldable leather/-plastic laminate which is processed to have the unique contours to receive a selected handgun 20 and is not suitable as a holster for any other gun shape.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United State is:

1. In a handgun holster adapted to permit withdrawal of a handgun having a trigger guard from said holster by a generally vertical upward movement of a handgun, said holster having with respect to a wearer an inner wall, an outer wall, a front, a back, a top, a bottom, an inside, an outside, and a means for suspending said holster from a belt worn by a wearer, the improvement which comprises a handgun restraining device attached to said inside of said holster at said back adjacent said top, said restraining device being an elongated article having a solid rigid body portion and two upwardly extending vertical side wall members attached to opposite sides respectively of said body portion and having upper free ends, said side walls and said body portion forming a channel adapted to receive and seat therein a trigger guard of a handgun, said upper free ends each including a spring biased cam-shaped restraining member having two lobes and pivotable about an axis passing therebetween, one said lobe being biased to extend inwardly into said channel when the holster is empty and to be pushed outwardly into a cavity in said side wall when the trigger guard is seated in said channel, and another said lobe being biased to be retracted into said cavity of said side wall when the holster is empty and to extend inwardly of the trigger guard when the trigger guard is seated in the channel.

2. The holster of claim 1 wherein said upper free ends are semiflexible toward and away from each other.

3. The holster of claim 2 which additionally comprises an adjustment screw passing through both said free ends and said body portion and adapted to be tightened to reduce the flexibility of said free ends and to increase frictional engagement with a handgun positioned between said side wall members.

4. The holster of claim 1 which additionally includes a rounded tongue extending forwardly from said body portion to function as a guide to direct a muzzle of a handgun and thus the trigger guard into said channel when the handgun is being holstered.

5. The holster of claim 1 which additionally includes a ledge spacedly below said channel on said body portion facing said front and adapted to receive and to seat a corresponding ledge on a handgun.

6. The handgun holster of claim 1 wherein each said cam-shaped member one said lobe fits closely within said cavity and extends generally horizontally, and spring means biasing said one lobe inwardly.

7. The handgun holster of claim 6 wherein said side wall members include lower ends, and means mounting said lower ends to said body portion spacedly below said channel.

8. The holster of claim 1 which has an open top, an open bottom, and said front is open from said top downwardly to adjacently above said bottom.

9. The holster of claim 1 further comprising a pivot pin connecting each said restraining member to respective said side wall members and a compression spring between each said one leg and said side wall member to which each said one leg is attached via its said pivot pin.

10. The holster of claim 9 wherein said pivot pin extends substantially horizontally.

11. The holster of claim 9 wherein said pivot pin extends substantially vertically.

12. The holster of claim 1 wherein said axis is substantially horizontal.

13. The holster of claim 1 wherein said axis is substantially vertical.

14. In a holster adapted to permit withdrawal of a handgun having a trigger guard from said holster by a generally vertical upward movement of a handgun, said holster having with respect to the wearer an inner wall, an outer wall, a front, a back, a top, a bottom, an inside, an outside, and means for suspending said holster from a belt worn by a wearer, the improvement which comprises a handgun restraining device attached to said inside of said holster adjacent said back and top, said restraining device being an elongated article having a solid rigid body portion and two upwardly extending vertical side wall members having lower ends attached to opposite sides respectively of said body portion and forming a channel adapted to receive and seat a trigger guard of a handgun, said upper free ends each including a spring biased cam-shaped restraining member having two lobes, pivot means attaching each said restraining member for movement on generally parallel axes, a first of said lobes of each said restraining member being biased to extend inwardly of said channel when said holster is empty and to be pushed outwardly into a cavity formed within a side wall member when a trigger guard of a handgun is seated in said channel, and a second of said lobes of each said restraining member being biased and retracted into said cavity of said side wall when said holster is empty to permit a trigger guard to pass between opposed said first lobes of said restraining members and to extend inwardly of a trigger guard when a trigger guard is seated in said channel to releasably restrain a trigger guard and handgun in said holster.

15. The holster of claim 14 wherein said upper free ends are semiflexible toward and away from each other.

16. The holster of claim 15 further comprising an adjustment screw passing through both said free ends and said body portion and adapted to be tightened to reduce the bendability of said free ends thus increasing the force required to withdraw a handgun from said holster.

17. The holster of claim 14 further comprising a rounded tongue extending forwardly from said body portion to guidingly direct a muzzle of a handgun and thus a trigger guard into said channel when a handgun is being holstered.

18. The holster of claim 14 further comprising a ledge spaced downwardly from said channel and disposed on said body portion facing said front and adapted to receive and to seat a cooperating ledge of a handgun.

19. The holster of claim 14 wherein each said second lobe is substantially rectangular and each said first lobe is substantially triangular.

20. The holster of claim 14 wherein said pivot means includes a pair of pins respectively attached to said side walls and passing through respective said restraining members.

21. The holster of claim 20 wherein said pins extend substantially horizontally.

22. The holster of claim 20 wherein said pins extend substantially vertically.

23. The holster of claim 14 wherein each said first lobe includes a portion to inhibit dislodgment of a handgun from said holster in a forward direction without prior vertical draw of a handgun.

24. The holster of claim 23 wherein each said first lobe includes a surface portion for permitting withdrawal of a holstered handgun in substantially a vertical draw which overcomes friction between a handgun and said restraining device, other parts of said holster and a weight of a handgun.

25. The holster of claim 24 wherein said top and bottom are open and said front is open from said top downwardly to a position adjacently above said bottom whereby a handgun is initially drawn vertically to clear a lower portion of said front and thence can be pivoted to a shooting position through said open front.

26. The holster of claim 14 wherein said pivot means includes a pair of spaced pivot pins connecting between each said restraining member and said side wall members, said device further including a pair of compression springs respectively positioned between said side wall members and said second lobes to bias said second lobes inwardly toward each other when said holster is empty and thus to bias said first lobes outwardly.

27. The holster of claim 14 wherein said axes are substantially horizontal.

28. The holster of claim 14 wherein said axes are substantially vertical.

* * * * *